United States Patent [19]

Brutosky

[11] 4,336,670

[45] Jun. 29, 1982

[54] GATE ASSEMBLY

[76] Inventor: Andrew J. Brutosky, Box 883, Choteau, Mont. 59422

[21] Appl. No.: 180,572

[22] Filed: Aug. 25, 1980

[51] Int. Cl.[3] ..... E05D 13/02;

[52] U.S. Cl. ..... 49/409; 16/95 R; 49/362; 49/427

[58] Field of Search ..... 49/409, 427, 425, 362; 16/87 R, 91, 95 R, 96

[56] References Cited

U.S. PATENT DOCUMENTS

| | | | |
|---|---|---|---|
| 979,302 | 12/1910 | Horner | 49/427 |
| 1,073,563 | 9/1913 | Bemis | 49/427 X |
| 2,912,713 | 11/1959 | Nelson | 16/95 R |
| 3,502,132 | 3/1970 | Hagex et al. | 160/331 |
| 3,705,468 | 12/1972 | Ashworth | 49/409 |
| 3,740,898 | 6/1973 | McKenzie | 49/409 |
| 3,918,201 | 11/1975 | Graziano | 49/362 X |

*Primary Examiner*—Philip C. Kannan
*Attorney, Agent, or Firm*—Arthur L. Urban

[57] ABSTRACT

A gate assembly including an upstanding frame member, an elongated main support member affixed to the frame member, an elongated intermediate support member capable of telescoping into the main support member, the intermediate support member including vertically disposed, spaced support sections, a plurality of rollers mounted on the vertical support sections, the rollers being rotatable on horizontal shafts extending from the vertical support sections, certain of the rollers extending slightly above the top edges of the vertical support sections and other of the rollers extending slightly below the bottom edges of the vertical support sections, an elongated inner support member having a generally T-shaped cross section with the top portion of the T member being disposed in a generally horizontal position, the inner support member being capable of telescoping into the intermediate support section, the horizontal portion of the T member having a thickness slightly smaller than the vertical spacing between the upper and lower rollers of the intermediate support section, the vertical portion of the T member having a thickness slightly smaller than the spacing between the opposed spaced horizontal lower support sections of the main support member, and mechanism for suspending a gate below the inner support member.

10 Claims, 6 Drawing Figures

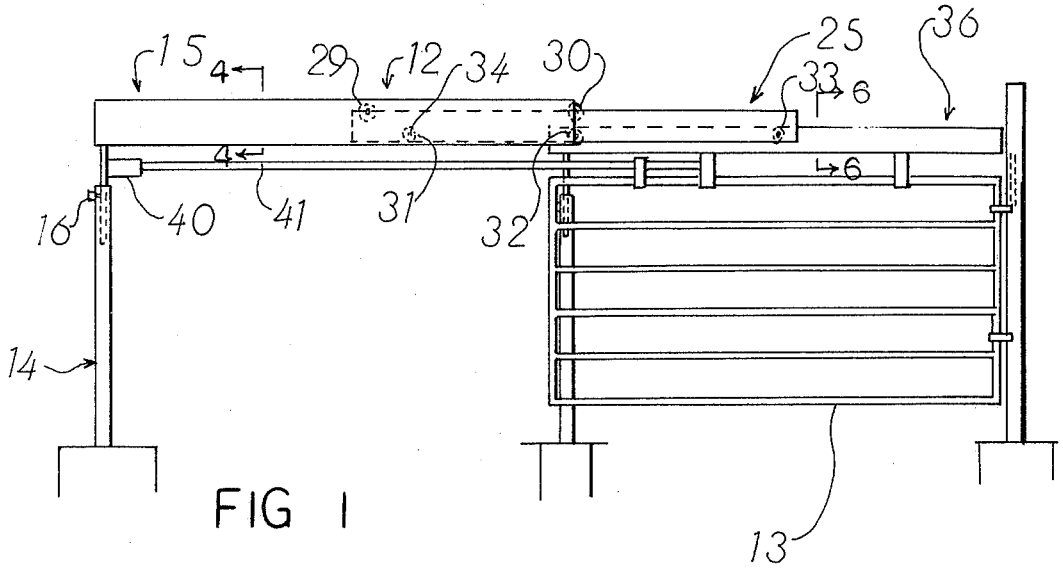
FIG 1
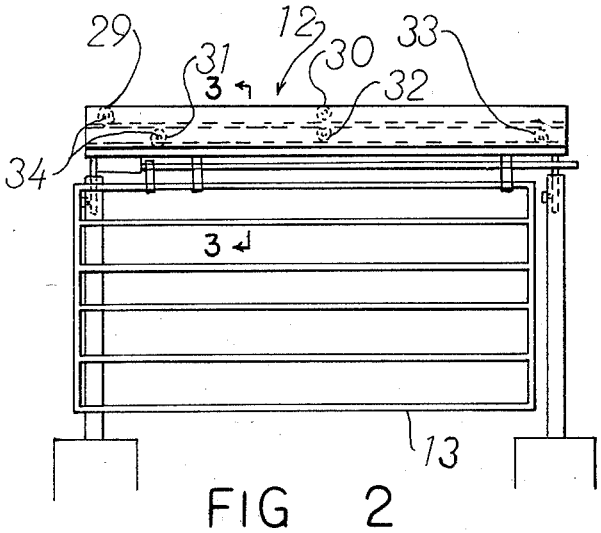
FIG 2
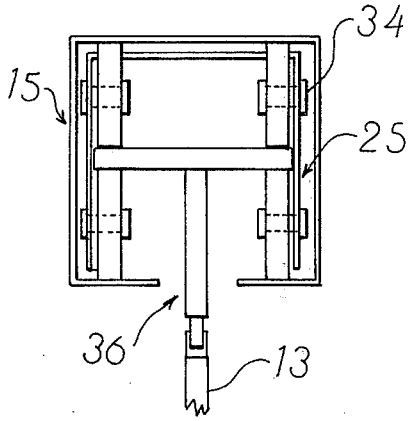
FIG 3
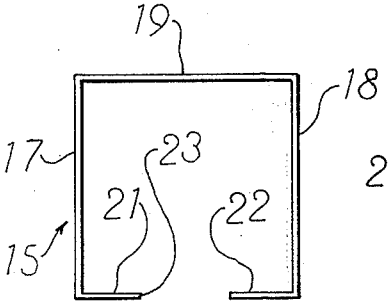
FIG 4
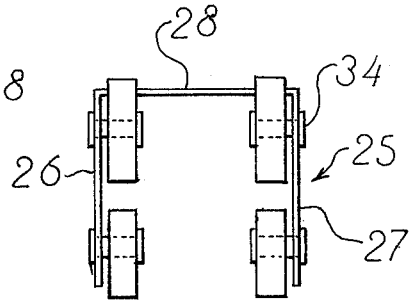
FIG 5
FIG 6
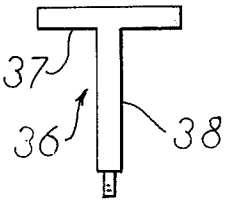

GATE ASSEMBLY

This invention relates to a novel gate assembly and more particularly relates to a new gate assembly which can be operated automatically.

For many centuries, individuals have enclosed their land to protect their home and other property. This has been done both in urban and rural areas. In some cases, the enclosures have been simple fences to keep children or animals confined, while in other situations, the fencing serves to protect the property against human or animal intruders.

Regardless of the type of enclosure or fencing utilized, some type of opening must be provided for ingress and egress to and from the property. Generally, the opening has a gate. Gates commonly are used for walkways and roadways. The most common gate style is the swinging gate. While swinging gates are satisfactory for walkways, their use becomes more cumbersome as they increase in size, such as for roadways.

Conventional roadway gates have a number of drawbacks. For example, the weight of roadway gates presents a problem in the selection of the hinges. Also, the weight may make the gate difficult to operate. In an attempt to solve these problems, pairs of gates meeting at the center sometimes are used.

Another problem with roadway gates is the necessity for getting out of the vehicle to open the gate, driving the vehicle through and getting out of the vehicle again to close the gate. This is troublesome even under ideal weather conditions, but in inclement weather and at night it is especially unpleasant.

It has been proposed to utilize power operated roadway gates. However, mechanisms to operate swinging gates are complicated and expensive. As a result, other proposals for power operated roadway gates have been made. Some gates have an overhead framework into which the gates are raised. Such gates of necessity have limited overhead clearance and are unsightly in appearance because of the overhead structural elements.

The present invention provides a novel gate assembly which is simple in design and relatively inexpensive to manufacture. The gate assembly can be fabricated from commercially available components and materials. The gate assembly of the invention can utilize prefabricated gates or those which are custom fabricated to provide a particular functional or decorative effect.

The gate assembly of the invention can be operated simply and conveniently both manually or with a power source. The gate assembly can be powered by a conventional garage door opening unit. The gate assembly can be operated manually using only a minimum of effort. Thus, the gate assembly of the invention can be opened easily in the event of a power stoppage.

The gate assembly of the invention can be installed by a homeowner or a ranch hand with a minimum of instruction. The gate assembly is suitable for use both in new installations and as an addition to existing gates. The gate assembly is durable and has a long useful life with little maintenance.

Other benefits and advantages of the novel gate assembly of the present invention will be apparent from the following description and the accompanying drawings in which:

FIG. 1 is a side elevation partially in section of one form of the gate assembly of the invention in a closed position;

FIG. 2 is a side elevation partially in section of the gate assembly shown in FIG. 1 in an open position;

FIG. 3 is a sectional view of the gate assembly taken along line 3—3 of FIG. 2;

FIG. 4 is a cross-sectional view of the outer support member of the gate assembly taken along line 4—4 of FIG. 1;

FIG. 5 is a cross-sectional view of the intermediate support member of the gate assembly of FIG. 1; and FIG. 6 is a cross-sectional view of the inner support member of the gate assembly taken along line 6—6 of FIG. 1.

As shown in the drawings, one form of the novel gate assembly of the invention includes a gate supporting portion 12 and a gate portion 13 carried by the supporting portion and movable with respect thereto. The gate supporting portion 12 includes a frame 14 with an elongated main support member 15 affixed to the frame. The main support member 15 is disposed in a generally horizontal position. Advantageously, the main support member 15 is connected to the frame 14 through adjusting means shown as a rod and sleeve arrangement 16 with suitable fasteners to maintain proper alignment of the components.

The main support member 15 includes vertically disposed sections 17 and 18 which are spaced from one another. An upper horizontal section 19 connects the vertical support sections 17 and 18. While it is advantageous to utilize an upper section 19 which fully covers the space between vertical sections 17 and 18 to protect the gate assembly from the weather to a greater degree, under some situations the upper section 19 may be divided into a number of smaller sections spaced along the length of the main support member.

The main support member 15 also includes opposed horizontally disposed lower support sections 21 and 22. Sections 21 and 22 each extend from one of the vertical support sections 17 and 18. The lower support sections 21 and 22 extend toward each other but terminate short of meeting. This configuration provides a longitudinal opening 23 along the bottom of the main support member. Advantageously, the main support member 15 is formed of an elongated box channel member with the longitudinal opening 23 cut in the bottom portion thereof.

The gate supporting portion 12 further includes an elongated intermediate support member 25 capable of telescoping into the main support member 15. The intermediate support member 25 includes vertically disposed support sections 26 and 27 which are spaced from one another and joined with a top section 28 as shown. The intermediate support member 25 advantageously may be formed of an elongated channel member with a U-shaped cross section which is inverted so that the open side thereof faces the bottom. When the intermediate support member has a closed section at the top, the rollers 29–30 will extend through openings in the closed section.

A plurality of roller means 29–33 are mounted on the vertical support sections 26 and 27. The roller means are mounted for rotation on horizontal shafts 34 that extend from the vertical support sections 26 and 27. The rollers 29–33, preferably are individual rollers as shown carried by horizontal shafts extending inwardly from the vertical sections 26 and 27 of the intermediate support member 25.

Certain of the roller means, namely, rollers 29 and 30 extend slightly above the top edges of the vertical support sections 26 and 27. Other of the roller means, that is, rollers 31, 32 and 33 extend slightly below the bottom edges of the vertical support sections. Advantageously, pairs of the upper and lower rollers, for example, rollers 30 and 32, are disposed with the upper and lower rollers positioned closely adjacent to one another in a substantially vertical plane. Preferably, the rollers 29–33 are arranged so that rollers are located at the upper corner of the intermediate support member 25 remote from the end thereof which the gate 13 enters. Rollers 29 are shown in this configuration. Also, it is desirable that the pairs of rollers 30 and 32 be located intermediate along the length of the intermediate support member 25 to provide support for the gate 13 when it is in an extended position.

An inner elongated support member 36 also is included in the gate supporting portion 12. Inner support member 36 has a generally T-shaped cross section. Inner support member 36 has the top portion 37 of the T member disposed in a generally horizontal position. Inner support member 36 is capable of telescoping into intermediate support section 25.

The horizontal bar portion 37 of T member 36 has a thickness slightly smaller than the vertical spacing between the upper and lower rollers of intermediate support section 25, that is, the space between rollers 30 and 32. The vertical bar portion 38 of T member 36 has a thickness slightly smaller than the spacing between opposed horizontal lower support sections 21 and 22 of main support member 15. The spacing between the sections 21 and 22 constitutes the width of longitudinal opening 23. The inner support member 36 also advantageously includes gate suspending means which includes connecting means associated with the vertical bar portion 38 of the T-shaped inner support member.

If desired, gate activating means may be provided to effect movement of the gate 13 from a closed or extended position to an open or retracted position and back to a closed position. The gate activating means advantageously includes drive means such as an electrical motor mounted adjacent the end of the main support member 15 from which the gate moves. The drive means is operatively connected to the gate through a chain and sprocket or more preferably through a worm arrangement 41. Suitable gate activating means may be a conventional garage door opening unit.

In the operation and use of the gate assembly of the present invention as shown in the drawings, the gate activating mechanism may be actuated such as with a radio transmitter (not shown) of a garage door operator 40. This starts the operation of the electrical motor and the rotation of the worm 41 connected thereto. The worm 41 moves a follower attached to inner support member 36 traversing it to a position under the main support member 15.

The inner support member 36 telescopes into the intermediate support member 25 and the intermediate support member telescopes into the main support member 15. Since the gate is suspended below the inner support member 36, the gate will be drawn into the space below the main support member 15 and thereby into an open position which clears the roadway that ordinarily is barricaded by the gate.

To close the gate assembly, the radio transmitter may be actuated again to reverse the direction of the motor 40 and reverse the direction of travel of the inner support section 36, the intermediate support member 25 and the gate 13 attached to the inner support member. As the inner support member 36 is moved from below intermediate support member 25, the intermediate support member also moves from below the main support member 15. This movement continues until the gate 13 has reached a closed position as shown in FIG. 2.

In this extended position, part of the intermediate support member 25 remains within the main support member 15, while the other part of the intermediate support member which extends beyond the main support member 15 has a portion of the inner support member 36 telescoped therein. In this way, the inner support member 36 can be substantially completely removed from below the main support member 15, while still being operatively connected thereto.

Operation of the gate assembly of the invention also can be effected through the use of electrical switches located adjacent the gate assembly or manually, if desired. Manual operation can be achieved conveniently by disconnecting the linkage between the worm and the gate. Then, the gate 13 is pushed from a closed position to an open position below the main support member 15. The gate 13 can be returned to a closed position when desired by pulling the gate closed. The various components of the gate assembly function in the manner described above for the motor driven operation.

The above description and accompanying drawings show that the present invention provides a novel gate assembly which is simple in design and convenient to use. The gate assembly of the invention can be fabricated from commercially available components and materials relatively inexpensively. The gate assembly of the invention can utilize commercially available gates or custom fabricated gates.

The gate assembly of the invention can be operated manually or with a power source and even by a conventional garage door opening unit. The gate assembly can be operated manually with a minimum of effort. Also, the gate assembly can be operated through a radio transmitter or suitable switches.

The gate assembly of the present invention can be installed by a homeowner or a ranch hand with a minimum of instruction. In addition, the gate assembly provides for the adjustment of the control mechanism as components thereof age and/or wear.

It will be apparent that various modifications can be made in the particular gate assembly described in detail above and shown in the drawings within the scope of the invention. For example, the size and configuration of the components can be changed to meet specific requirements. Also, a variety of structural materials may be utilized in the fabrication of the gate assembly as desired. Therefore, the scope of the invention is to be limited only by the following claims:

What is claimed is:

1. A gate assembly including an upstanding frame member, an elongated main support member affixed to said frame member, said main support member being disposed in a generally horizontal position, said main support member including vertically disposed spaced support sections, an upper horizontal section connecting said main vertical support sections, opposed horizontally disposed lower support sections extending from said main vertical support sections toward one another but terminating short thereof to provide a longitudinal opening therebetween, an elongated intermediate support member telescoping into said main support member, said intermediate support member including vertically disposed, spaced support sections, a plurality of roller means mounted on said intermediate vertical support sections, said roller means being rotatable on horizontal shafts extending from said intermediate vertical support sections, certain of said roller means extending slightly above the top edges of said intermediate vertical support sections and other of said roller means extending slightly below the bottom edges of said intermediate vertical support sections, an elongated inner support member having a generally T-shaped cross section with the top portion of the T member being disposed in a generally horizontal position, said inner support member telescoping into said intermediate support member, the horizontal portion of said T member having a thickness slightly smaller than the vertical spacing between said upper and lower roller means of said intermediate support section, said vertical portion of said T member having a thickness slightly smaller than the spacing between said opposed spaced horizontal lower support sections of said main support member, and mechanism for suspending a gate below said inner support member, whereby a gate suspended below said inner support member can be moved from a position below said main support member to a position to one side of said main support member.

2. A gate assembly according to claim 1 wherein said main support member is an elongated box channel member with a longitudinal opening in the bottom portion thereof.

3. A gate assembly according to claim 1 wherein said intermediate support member is an inverted U-shaped channel member and said roller means extend through the top section thereof.

4. A gate assembly according to claim 1 including drive means for effecting movement of said gate means.

5. A gate assembly according to claim 1 wherein said gate suspending means includes connecting means associated with said vertical portion of said T-shaped inner support section.

6. A gate assembly according to claim 1 wherein said roller means are individual rollers carried by horizontal shafts extending inwardly from said vertical sections of said intermediate support member.

7. A gate assembly according to claim 1 including adjusting means disposed between said frame member and said main support member.

8. A gate assembly according to claim 4 wherein said drive means includes an electrical motor mounted on said main support member remote from said gate when said gate is in a position to one side of said main support member.

9. A gate assembly according to claim 1 wherein roller means is located on said intermediate support member remote from said gate when said gate is in a position to one side of said main support member.

10. A gate assembly according to claim 1 wherein a pair of upper and lower roller means is disposed closely adjacent to each other in a substantially vertical plane located intermediate along the length of said intermediate support member.

* * * * *